US009206623B2

(12) United States Patent
Salomonson

(10) Patent No.: US 9,206,623 B2
(45) Date of Patent: Dec. 8, 2015

(54) BURGLAR ALARM ARRANGEMENT

(76) Inventor: Ben Salomonson, Espoo (FI)

( * ) Notice: Subject to any disclaimer, the term of this patent is extended or adjusted under 35 U.S.C. 154(b) by 37 days.

(21) Appl. No.: 13/642,547

(22) PCT Filed: Apr. 15, 2011

(86) PCT No.: PCT/FI2011/050335

§ 371 (c)(1),
(2), (4) Date: Oct. 21, 2012

(87) PCT Pub. No.: WO2011/131831

PCT Pub. Date: Oct. 27, 2011

(65) Prior Publication Data

US 2013/0038449 A1 Feb. 14, 2013

(30) Foreign Application Priority Data

Apr. 20, 2010 (FI) ..... 20100195 U
Apr. 20, 2010 (FI) ..... 20105420

(51) Int. Cl.
*G08B 13/08* (2006.01)
*E05B 45/06* (2006.01)
*E05B 47/00* (2006.01)

(52) U.S. Cl.
CPC ..... *E05B 45/06* (2013.01); *E05B 2047/0068* (2013.01)

(58) Field of Classification Search
CPC ..... E05B 2047/0068; E05B 45/06
USPC ..... 340/545.1; 292/1, 92, DIG. 65; 70/432, 70/DIG. 49
See application file for complete search history.

(56) References Cited

U.S. PATENT DOCUMENTS

| | | | | |
|---|---|---|---|---|
| 4,303,909 | A * | 12/1981 | Martin | 340/543 |
| 4,760,380 | A * | 7/1988 | Quenneville et al. | 340/542 |
| 4,803,467 | A | 2/1989 | Peters | |
| 5,680,095 | A * | 10/1997 | Nassouri | 340/426.28 |
| 5,783,995 | A | 7/1998 | Jackson | |
| 2003/0052780 | A1 * | 3/2003 | Buckley | 340/547 |
| 2005/0030178 | A1 * | 2/2005 | Meijer | 340/542 |

FOREIGN PATENT DOCUMENTS

| | | |
|---|---|---|
| GB | 2208305 | 3/1989 |
| GB | 2288427 | 10/1995 |
| GB | 2348311 | 9/2000 |
| GB | 2463943 | 4/2010 |
| JP | 11-224383 | 8/1999 |

* cited by examiner

*Primary Examiner* — Ojiako Nwugo
(74) *Attorney, Agent, or Firm* — Mark M. Friedman

(57) ABSTRACT

The invention relates to a burglar alarm arrangement, which can be installed in a mechanical lock, which mechanical lock comprises at least a lock cylinder (204), a lock frame (208) and a turn knob (214). A burglar alarm arrangement according to the present invention can be installed in a mechanical lock without a need to change keys, rekeying the lock or without adding code systems. Additionally, the burglar alarm arrangement can identify an authorized opening of the door by use of the key or the turn knob, and deactivate the alarm system for that time. The burglar alarm arrangement comprises an alarm system and first means (206) and second means (212), which first and second means (206 and 212) are functionally connected to the alarm system.

6 Claims, 1 Drawing Sheet

BURGLAR ALARM ARRANGEMENT

FIELD OF TECHNOLOGY

The invention relates to a burglar alarm arrangement. Specifically, the invention relates to a burglar alarm arrangement, which can be installed in a mechanical lock.

BACKGROUND OF THE INVENTION

Basement and storage break-ins are all too commonplace, for instance in apartment buildings. Usually these spaces have been forcefully entered by breaking the door, or by breaking the lock in the door. In order to prevent break-ins, various types of burglar alarms can be installed into basement and storage doors, for instance, systems using codes, electric locks, access control systems, or coded keys.

However, installing such systems is expensive and troublesome. The system in use must be so simple, that all the residents can learn to use it and there is a great danger with systems based on different codes due to the number of residents, in that the deactivation code of the alarm may fall into the wrong hands when residents change. Also the code keys can be lost, which leads to significant costs when a large number of keys must be replaced.

Burglar alarm systems installed in apartment doors have the same kind of problems as the alarm systems installed into basement and storage spaces. Especially children and elderly people have difficulties in learning to use difficult systems properly, and carrying extra code keys is a risk.

An additional problem of many burglar alarm systems is that users do not remember to activate them when they leave the space monitored by the alarm system.

DESCRIPTION OF THE INVENTION

The objective of the present invention is to create a solution in which the above mentioned defects have either been eliminated, or their effects have been reduced. Specifically, the invention is aimed at solving how a burglar alarm arrangement can be installed into a mechanical lock without changing the keys, rekeying the lock or without adding code systems. Additionally, the invention is aimed at solving how the burglar alarm arrangement can identify an authorized opening of the door and deactivate the alarm system for that time.

The objectives of the invention are met by installing into a mechanical lock a burglar alarm arrangement, which burglar alarm arrangement comprises at least an alarm system and a first and second means, which first and second means have been functionally connected to the alarm system. The alarm system, when activated, is arranged perform an alarm if the door is opened. The first and second means have been arranged to perform an indication as a result of a first and second action.

A burglar alarm arrangement according to the invention is characterized by what is disclosed in the characterizing part of claim 1.

In one embodiment of the invention the alarm system comprises a door detector and an alarm device arranged into a functional connection with the detector. The door detector can be, for instance, a pair of magnetic contacts.

In one embodiment of the invention the first and second means are micro-switches.

In one embodiment of the invention the first action can comprise unlocking the lock with the right key, and the second action can comprise unlocking the lock by the turn knob.

In yet another embodiment of the invention the indication performed by the first and second means causes the deactivation of the alarm system.

Some advantageous embodiments of the invention have also been disclosed in the dependent claims.

Significant advantages are achieved by using the invention. It may be possible to install a burglar alarm arrangement according to the present invention in all mechanical locks. Additionally, the burglar alarm arrangement may also be installed afterwards in most lock and door combinations. The burglar alarm arrangement may also be installed without a need to change keys, the lock and/or rekey the lock in connection with the installation, or to add, for instance, a code system. An advantage of the present invention is that the alarm can always be activated in doors which have a burglar alarm arrangement according to the present invention installed, without users having to remember to switch the alarm on or off.

The present invention has a wide span of applications, for example, in doors used only occasionally, such as attic or basement doors in apartment buildings, or in apartment doors.

In this application, the term "activation of the alarm system" refers to setting the alarm system to standby.

In this application, the term "deactivation of the alarm system" refers to switching off of the alarm system.

In this application, the term "door-closed mode" refers to a position of the door, in which the door is substantially aligned with the doorframe.

In this application, the term "door-open mode" refers to a position of the door, in which the lines of the door and the doorframe diverge substantially from each other.

BRIEF DESCRIPTION OF THE FIGURES

The preferred embodiments of the invention are described below in more detail with reference to the accompanying drawings, in which.

DETAILED DESCRIPTION OF EMBODIMENTS

A burglar alarm arrangement according to the invention comprises at least an alarm system and first and second means, which have been functionally connected to the alarm system.

Figure 1:
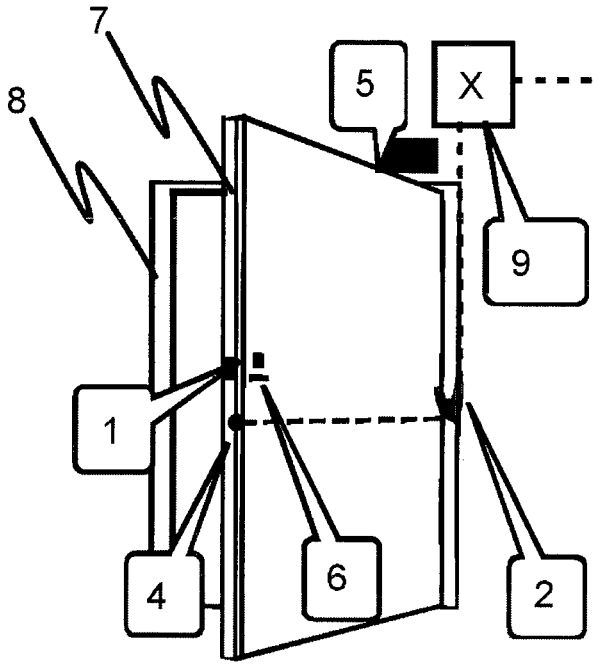
FIG. 1 depicts the principle diagram of a burglar alarm arrangement according to an embodiment of the invention installed in a door.

FIG. 1 depicts the principle diagram of a burglar alarm arrangement according to an embodiment of the invention installed in a door. The first and second means, which are micro-switches in this embodiment, are arranged in a lock cylinder/frame 1 to detect the first and/or second action directed at the lock cylinder/frame 1 and/or a turn knob 6. The door detector 4, in this embodiment a pair of magnetic contacts, is installed in the door 7 and in the doorframe 8 corresponding to the lock. The functional connecting of the door detector 4 to the alarm 9 is accomplished in this embodiment by using cables 2. The embodiment shown in FIG. 1 the door also has a door closer 5 to ensure the closing of the door.

According to one embodiment, the alarm system of the burglar alarm arrangement, when activated, is preferably arranged to perform an alarm in the door-open mode. An indication can be performed with the first and second means arranged in connection with the lock as a result of the first and second action; the mentioned indication can be the deactivation of the alarm system.

Figure 2:
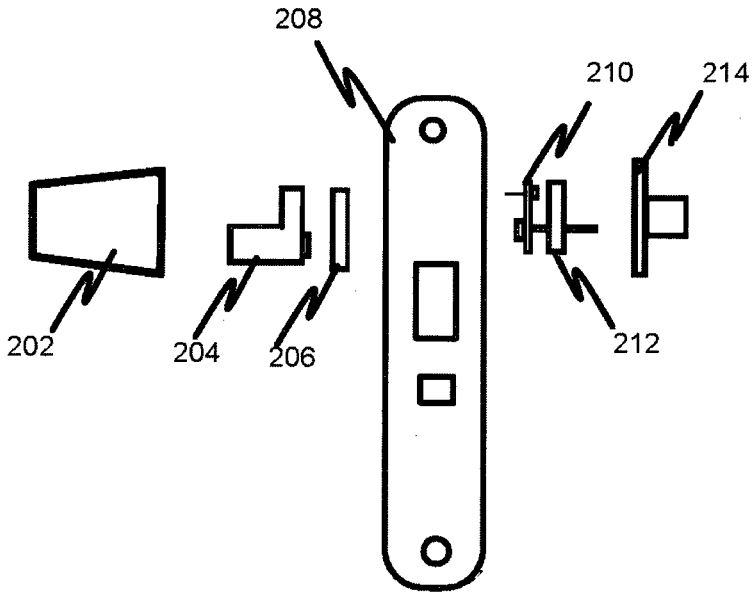
FIG. 2 depicts an example of an embodiment for installing first and second means in a mechanical lock.

FIG. 2 shows an exemplary embodiment for installing first and second means in a mechanical lock. In FIG. 2, the first means 206 are located between the lock cylinder 204 and lock frame 208, which lock cylinder is placed under the fitting 202. According to the embodiment in question, the first action is turning the correct key, which is intended for the lock, in the lock cylinder 204, which causes the first means to perform an indication to the alarm system for deactivating the alarm system.

In the embodiment in FIG. 2, the second means 212 are located under the turn knob 214 on top of a connecting plate and a locking bar 210, and the second action is the opening of the door by turning the turn knob 214, which causes the second is the opening of the door by turning the turn knob 214, which causes the second means 212 to perform an indication to the alarm system for deactivating the alarm system.

Thus, as a result of the first and second action, the door can be opened by using a suitable key, or using the turn knob, without the alarm system triggering an alarm.

According to a preferred embodiment, the first and second means are micro-switches arranged to change their mode as a result of an outside action. Opening the door with a key causes the lock cylinder wrench to turn the micro-switch to another mode. In the same way, opening the door by turning the turn knob causes the turn knob to turn the micro-switch to another mode.

When the key is removed from the lock or the wrench returns to its starting position, the micro-switch changes its mode again, which, according to one embodiment, causes the alarm system to activate itself again. According to another embodiment, the alarm system has preferably been arranged to always activate itself in the door-closed mode.

The alarm system of the present invention can be comprised of a door detector and alarm device, which have been functionally connected to each other. As a door detector can be used any type of system arranged to identify the door-closed and door-open modes. As an alarm device, for its part, can be used any type of methods and instruments, which are arranged to indicate, for example, a broken lock, such as a buzzer, alarm light, message to an alarm centre, or an SMS, just to mention a few examples. All known means, for instance a cable, can be used to functionally connect the door detector and the alarm. Since the technology for installing of such an alarm system into a door is known, it will not be described in more detail.

According to one preferred embodiment, as a door detector is used a pair of magnetic contacts. Thus, the first and second means have preferably been connected to the pair of magnetic contacts so that the pair of magnetic contacts are activated and/or deactivated based on the indications from the first and second means. Since the operation and installation of a pair of magnetic contacts in connection with a lock is a previously known technology, it will not be described in more detail.

A burglar alarm arrangement according to the present invention can be installed in a mechanical lock, which mechanical lock comprises at least a lock cylinder, lock frame, and turn knob. The burglar alarm arrangement is possible to install in doors afterwards.

Only some of the embodiments of a solution according to the invention have been disclosed above. The scope of the invention is defined in the following claims. It is, however, obvious for a man skilled in the art that the details of different features of the invention can alternate in certain amount within inventive overall idea subject to each embodiment of invention.

The invention claimed is:

1. A burglar alarm arrangement for a mechanical lock in a door, said mechanical lock comprising at least a lock cylinder, a lock frame and a turn knob, the burglar alarm arrangement comprising:

(a) an alarm system, which, when activated, is arranged to perform, an alarm when the door is in a door-open mode;

(b) first means functionally connected to the alarm system, said first means located between the lock cylinder and the lock frame of the mechanical lock; and (c) second means functionally connected to the alarm system, said second means located under the turn knob of the mechanical lock, said first means arranged to perform an indication as a result of a first action, said first action comprises unlocking the lock by turning a correct key in the lock cylinder, and said second means arranged to perform an indication as a result: of a second action, which said indication is arranged to cause deactivation of said alarm system.

2. The burglar alarm arrangement of claim 1, wherein said alarm system comprises a door detector and an alarm device functionally connected thereto.

3. The burglar alarm arrangement of claim 2, wherein said door detector is a pair of magnetic contacts.

4. The burglar alarm arrangement of claim 1, wherein said alarm system is arranged always to be activated when the door is in the door-closed mode.

5. The burglar alarm arrangement of claim 1. wherein said first and second means are micro-switches.

6. The burglar alarm arrangement of claim 1, wherein said second action comprises unlocking the lock using the turn knob.

* * * * *